US006021523A

United States Patent [19]

Vero

[11] Patent Number: 6,021,523

[45] Date of Patent: Feb. 8, 2000

[54] HEAT AND ABRASION RESISTANT WOVEN GLOVE

[75] Inventor: Frederick A. Vero, Easthampton, N.Y.

[73] Assignee: Lakeland Industries, Ronkonkoma, N.Y.

[21] Appl. No.: 09/119,502

[22] Filed: Jul. 20, 1998

[51] Int. Cl.[7] ..... A41D 19/00

[52] U.S. Cl. ..... 2/159; 2/167

[58] Field of Search ..... 2/158, 159, 167, 2/169, 161.1, 161.5, 161.6; 57/210, 236, 243, 238, 244, 250, 258, 232; 66/174, 202

[56] References Cited

U.S. PATENT DOCUMENTS 4,912,821 4/1990 Mutsuo ..... 28/265

5,119,512 6/1992 Dunbar et al. ..... 2/167

5,362,527 11/1994 Harpell et al. ..... 428/33

5,407,739 4/1995 McCullough et al. ..... 428/287

5,686,011 11/1997 Lohmann et al. ..... 252/8.57

*Primary Examiner*—Michael A. Neas

*Assistant Examiner*—Gary L. Welch

*Attorney, Agent, or Firm*—John & Lezdey & Assoc

[57] ABSTRACT

A hand covering is provided which is heat and abrasion resistant. The hand covering is processed by utilizing a fabric formed with conditioned KEVLAR wound with a top cover of a yarn selected from the group consisting of PANOX and VECTRAN.

12 Claims, 1 Drawing Sheet

HEAT AND ABRASION RESISTANT WOVEN GLOVE

FIELD OF THE INVENTION

The present invention relates to a stain, heat and abrasion resistant woven glove. More particularly, there is provided a woven glove prepared by twisting KEVLAR® with a high temperature resistant polyester or oxidized polyacrylonitrile.

BACKGROUND OF THE INVENTION

There is a great need for protective gloves which are both abrasion resistant and heat resistant. There is a further need that the gloves have good flexibility and gripping ability. These features can usually be found with knitted gloves. However, heat resistant and abrasion resistant yarns such as those comprising an aramid are difficult to process because they fray during manufacturing or are too slippery to process. Therefore, the protective gloves are usually prepared with an outer film cover.

U.S. Pat. No. 5,224,363 to Sutton discloses protective garments which are produced from strand materials comprising KEVLAR strands combined with metallic strands which are extrusion coated with a flexible urethane. The wire strands prevent fraying and help provide cut resistance but the metal strands conduct heat. The garments include gloves.

U.S. Pat. No. 5,598,582 to Andrews et al discloses a hand covering having back hand and palm portions for protecting the user's hand from being cut or burned when in contact with hot objects. The hand covering contains an inner liner of KEVLAR yarn.

U.S. Pat. No. 4,454,611 to Tschirch et al discloses a heat resistant protective hand covering having a shell of a temperature resistant aromatic polyamide fiber.

The prior art is silent with respect to protective gloves of KEVLAR yarn twisted with another high temperature resistant yarn to form a knitted glove.

The term high strength as used herein refers to having a modulus of at least 600 gpd.

SUMMARY OF THE INVENTION

The present invention relates to a hand covering using strand material which is heat resistant, abrasion resistant and can be processed using substantially conventional textile fabric forming technology such as knitting. The hand covering comprises a back portion, a front portion and a wrist portion having an opening for the insertion of a wearer's hand. The back, front and wrist portion consists of conditioned KEVLAR strands twisted with a yarn selected from the group consisting of oxidized polyacrylonitrile and a high strength polyester polyacrylate. The KEVLAR strands are conditioned by treatment with steam and ignition resistant wax or organosilicone compound. The KEVLAR strands can have a Z-twist or a S-twist with the strands forming a top cover of the KEVLAR strands.

Advantageously, the twisted strands comprise a yarn of about 60 to 85 by weight of the oxidized polyacrylonitrile or the polyester polyacrylate.

It is therefore an object of the invention to provide a heat resistant and an abrasion resistant woven hand covering.

It is a further object of the invention to provide a woven glove containing KEVLAR which can be manufactured on substantially conventional knitting machines.

The objects and advantages of the invention will be better understood from the accompanying drawing and the description of the preferred embodiments.

DESCRIPTION OF THE PREFERRED EMBODIMENTS

Figure 1:
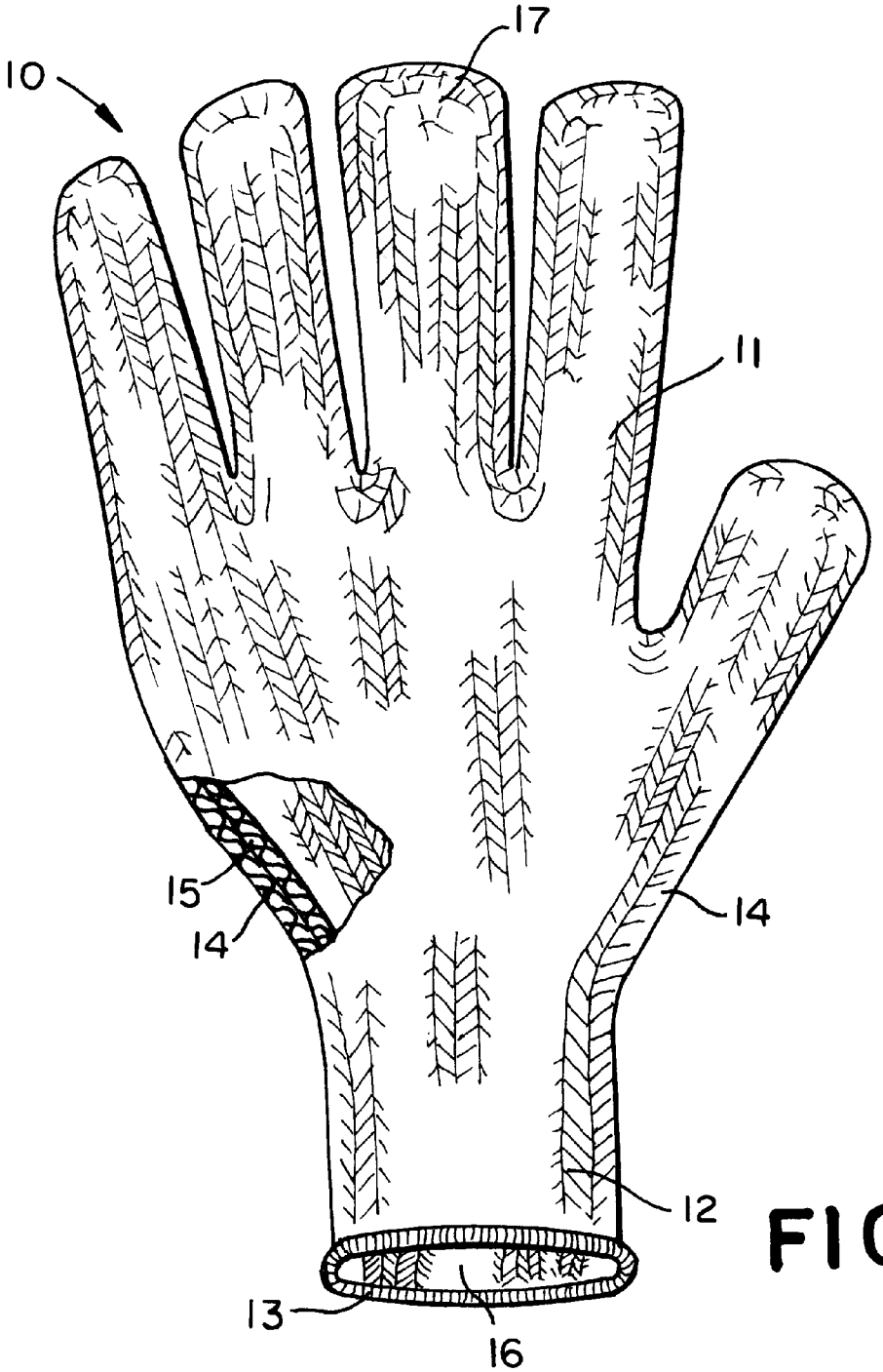
FIG. 1 is a top view of a hand covering of the invention with a cut-out section.

As seen in FIG. 1, the invention provides a hand covering 10 which is a woven fabric. The hand covering 10 comprises a woven wrist portion 12, a back portion 11 and a front portion (not shown). The wrist portion 12 has an opening 16 for insertion of a user's hand. The hand covering 10 can be in the form of a mitt or contain finger portions 17. The primary yarn which is used in the manufacture of the hand covering is strands of conditioned KEVLAR 15 which is twisted with a yarn 14 selected from the group consisting of oxidized or stabilized polyacrylonitrile and a high strength polyacrylate. The yarn can have either an S-twist or a Z-twist. The oxidized polyacrylonitrile or polyacrylate yarn is twisted over the KEVLAR with about 4 to 6 turns per inch of KEVLAR preferably about 5. The hand covering 10 comprises about 60 to 85% by weight of the oxidized polyacrylonitrile or polyacrylate yarn with the KEVLAR forming a bottom covering.

In order to process the KEVLAR on substantially standard knitting machines, it is essential that the KEVLAR be conditioned. Conditioning relates to the treatment of the KEVLAR strands with steam and then with an ignition resistant wax or an organosilicone compound. Preferably, the KEVLAR strands are steam treated before and after the application of the ignition resistant wax or organosilicone compound. The ignition resistant wax or organosilicone compound not only imparts ignition resistance and abrasion resistance to the yarn but prevents fraying of the yarn during processing. The organosilicone compound which is preferably in the form of a grease or wax has the following recurring units:

$$(\text{Si-O-Si-O})_n$$

Some suitable organosilicone compounds are mentioned in the Dow Chemical brochure entitled "Information About High Technology Material" 1986. The silicone compounds may be applied by dipping, spraying, rolling, or the like. Excess silicone compound is removed by the second steam treatment. Suitable organosilicone compounds include polysiloxane, silane wax, hydrolyzed partial condensation products of trimethoxymethylsilane, methoxytrimethylsilane, dimethoxy dimethysilane, and the like.

KEVLAR is a commercially available product of E.I. du Pont de Nemours. The KEVLAR strands can be KEVLAR-29, a high tensile strength p-aramid (2,758 G.Pa 400,000 psi) with moderate modulus and an elongation to break of 4.0% or KEVLAR-49 a p-aramid with the same tensile strength as KEVLAR-29 but higher modulus with an elongation to break of 2.5%.

The KEVLAR strands used preferably have a slight twist, generally about 1.1 per inch. The preferred size of the KEVLAR strands is about 384 to 416 denier (dn), most preferably 400 dn. The same denier is used for the wrapping yarn.

The stabilized or oxidized polyacrylonitrile which is used is available under the trademark PANOX from R.K. Carbon Fibers, Inc. of Philadelphia, Pa.

The high strength polyester polyacrylate which can be used is sold under the trademark VECTRAN by Celanese Corporation of Chatham, N.J., that is a liquid crystal polymer. Vectran has a tenacity of 10 gpd, elongation of 1.8%, an initial modulus of 640 gpd and a melting point of about 400 to 600° F.

It has been found to be advantageous to have the KEVLAR form the bottom cover to facilitate processing. The processing was further improved by conditioning the yarn before manufacturing the hand covering or gloves.

When the KEVLAR formed the top cover and/or the yarn was not conditioned the process experienced numerous breaks. In addition, the finished hand covering had similar characteristics of heat and abrasion resistance as a glove with the conditioned KEVLAR forming the top cover but the cost was substantially lower.

The textile fabric may be prepared with warp threads and filling threads being both of the yarn as hereinbefore described. Warp threads or filling threads may be of single or plied construction. The weave may be of any desired pattern to provide a stable textile fabric. For example, the fabric may comprise two up, two down twill and each of a width approximately ¼ to ½ inch. The weight of the fabric may be varied as desired but fabrics weighing about 5 to 16 ozs. per square yard, preferably about 10 oz/yd$^2$.

The wrist portion of the hand covering can be threaded with any suitable high melting elastomeric thread 13 or one which has expansion because of a twist or core.

What is claimed is:

1. An abrasion resistant woven hand covering to provide protection of a user's hand from being burned by contact with hot objects, said hand covering comprising:

a back portion, a front portion and a wrist portion having an opening for insertion of a wearer's hand, said back, front and wrist portions consisting essentially of a fabric consisting of conditioned aramid strands twisted with a yarn selected from the group consisting of oxidized polyacrylonitrile and a high strength polyester polyacrylate said aramid strands being conditioned by treatment with steam and a compound selected from the group consisting of an ignition resistant wax and an organosilicone compound, and wherein said yarn forming a top cover of said aramid strands.

2. The hand covering of claim 1 comprising about 60 to 85% of said yarn.

3. The hand covering of claim 1 comprising about 60 to 85% of a high strength polyester polyacrylate having a melting point of about 400 to 600° F.

4. The hand covering of claim 1 wherein said polyacrylonitrile or polyacrylate yarn is twisted over about 4 to 6 turns per inch of aramid strands.

5. The hand covering of claim 4 wherein said yarn is twisted with five turns per inch over aramid strands.

6. The hand covering of claim 1 wherein said organosilicone compound is a polysiloxane.

7. The hand covering of claim 1 wherein said aramid and said yarn each have a denier of about 384 to 416.

8. The hand covering of claim 1 wherein said aramid strands have a 1.1 twist.

9. The covering of claim 1 wherein said wrist portion includes elastomeric threads.

10. A woven glove having finger portions comprising a back portion, a front portion and a wrist portion having an opening for insertion of a wearer's hand, each of said portions consisting essentially of oxidized polyacrylonitriles strands twisted around conditioned aramid strands with about 5 turns per inch, said aramid being conditioned by treatment with steam and a compound selected from the group consisting of an ignition resistant wax and an organosilicone compound, said oxidized polyacrylonitrile forming a top cover on said aramid strands.

11. The glove of claim 10 wherein said aramid strands have a 1.1 twist and said aramid and oxidized polyacrylonitrile have a denier of about 400.

12. The glove of claim 10 wherein said organosilicone compound has the following recurring units:

$$(Si—O—Si—O)_n.$$

* * * * *